US006176013B1

(12) United States Patent
Lucente

(10) Patent No.: US 6,176,013 B1
(45) **Date of Patent: *Jan. 23, 2001**

(54) METHOD FOR FABRICATING A SEAMLESS H.V.A.C. TRUNK LINE ADAPTOR

(75) Inventor: Luigi E. Lucente, Chicago Heights, IL (US)

(73) Assignee: Green Street, Ltd., Frankfort, IL (US)

( * ) Notice: Under 35 U.S.C. 154(b), the term of this patent shall be extended for 0 days.

This patent is subject to a terminal disclaimer.

(21) Appl. No.: 09/315,699

(22) Filed: May 20, 1999

Related U.S. Application Data

(63) Continuation of application No. 08/929,549, filed on Sep. 15, 1997, now Pat. No. 5,933,954.

(51) Int. Cl.[7] ..... B23P 15/00
(52) U.S. Cl. ..... 29/890.14
(58) Field of Search ..... 29/890.14, 890.48, 29/890.15; 285/125.1

(56) References Cited

U.S. PATENT DOCUMENTS

| | | |
|---|---|---|
| 316,312 | 4/1885 | Tordoff . |
| 587,337 | 8/1897 | Smith . |
| 1,413,492 | 4/1922 | Rees . |
| 1,452,238 | 4/1923 | Finnigan . |
| 1,493,224 | 5/1924 | Alston, Jr. . |
| 1,608,180 | 11/1926 | Nathanson et al. . |
| 1,892,712 | 1/1933 | Taylor . |
| 1,966,403 | 7/1934 | Durham . |
| 2,175,575 | 10/1939 | Shoemaker . |
| 2,176,993 | 10/1939 | Gazey . |
| 3,344,498 | 10/1967 | Hack et al. . |
| 4,450,613 | 5/1984 | Ryan et al. . |
| 4,675,965 | 6/1987 | Offringa et al. . |
| 5,473,815 | 12/1995 | Sonden et al. . |

*Primary Examiner*—I Cuda
(74) *Attorney, Agent, or Firm*—Thomas J. Ring; Wildman, Harrold, Allen & Dixon

(57) ABSTRACT

Method for fabricating seamless adaptor for connecting trunk line HVAC duct to branch conduit including steps of positioning first segment of strip of sheet metal at first die assembly and exerting force onto first segment forming elliptical shaped segment, punching hole into central portion of elliptical segment and providing connector strip between first and trailing segment of metal strip; positioning elliptical segment at second die assembly and at same time positioning trailing segment at first die assembly and exerting force onto first and trailing segments, drawing elliptical segment at second die assembly into form having generally cylindrical shape projecting transverse to surface of the elliptical segment and positioning hole to be generally centered within end of form and forming annular rim surrounding hole and bending portion of elliptical shaped segment surrounding another end of form forming flange having a camber; positioning form at third die assembly and at same time positioning trailing segment at second die assembly and exerting force onto first and trailing segments with third and second die assemblies respectively, increasing diameter of hole at third die assembly and leaving a portion of annular rim surrounding hole positioned at end and inside of form; finally, positioning first segment at fourth die assembly and at same time positioning trailing segment at third die assembly and exerting force onto first and trailing segments with fourth and third die assemblies respectively, pushing portion of rim outwardly from inside of form to further increase diameter of hole positioned at end of form.

14 Claims, 6 Drawing Sheets

21
40
44
52
58
31'
56
85
56'
82
76
78
88
94
56''
19
20
12
116
114
C
D
16
18

METHOD FOR FABRICATING A SEAMLESS H.V.A.C. TRUNK LINE ADAPTOR

CROSS REFERENCE TO RELATED APPLICATION

This application is a continuation of U.S. patent application Ser. No. 08/929,549, now U.S. Pat. No. 5,933,954 entitled "Method For Fabricating A Seamless H.V.A.C. Trunk Line Adaptor" filed on Sep. 15, 1997, which is hereby incorporated by reference.

BACKGROUND OF THE INVENTION

1. Field of the Invention

The present invention relates to a method for fabricating a heating, ventilation and/or air conditioning trunk line adaptor, and more particularly, a method for fabricating a seamless heating, ventilation and/or air conditioning trunk line adaptor which is seamless.

2. Description of the related art including information disclosed under 37 CFR 1.97–1.99

Over the years as construction of buildings evolved, and central convection heating and air conditioning systems were developed, there likewise evolved a need to distribute the heated or cooled air to remote locations within a given building. Conduit systems were constructed to carry the conditioned air from the central heating and/or air conditioning system to the desired locations of the building.

Different rooms in various locations and various distances from the central heating and/or air conditioning system were serviced by the conduit systems. The conduit systems were designed with the concept of constructing larger trunk lines to carry the bulk of the conditioned air through the building and branch conduits were used to carry the conditioned air from these larger trunk lines to discrete room or area locations. The branching of the conduits from larger trunk lines required the branching conduits to be adapted to or connected to the trunk line to carry away conditioned air from the trunk line.

To connect a branching conduit to the main or trunk line, an adaptor was needed to secure the branch conduit to an opening in the main or trunk line. Adaptors typically have a flanged portion with a camber which overlies and conforms to the exterior round main or trunk line surface. The flanged portion defines an opening in the adaptor which communicates with the opening in the trunk line and the flanged portion of the adaptor surrounds the opening in the trunk line. The adaptor includes a conduit portion which communicates with the opening defined by the flanged portion and at the same time communicates with the opening in the trunk line and extends outwardly from the trunk line to engage a branch conduit.

These adaptors were constructed on site or at a remote location by cutting and bending metallic material into two separate pieces to form the flanged and the conduit portion. The flanged portion is cut and bent to the desired shape and is riveted or spot welded together. Another piece of metallic material is cut and bent to form a portion of the conduit which is riveted or welded together into a cylindrical form and, in turn, is riveted or welded to the flanged portion.

The construction of these adaptors, as can be seen, was labor intensive and, in turn, relatively costly. Moreover, the riveted or spot welded securement of the pieces do not permit the adaptors to be air tight. Openings are left between the rivets or spot welds which permits leakage of conditioned air from the system, thereby increasing the cost of heating or cooling of the building.

Unitary or seamless construction of these adaptors has recently become a much desired construction since leakage of conditioned air from the system is substantially prevented. However, it is only known that one other seamless adaptor has been constructed by Air Handling Systems of Woodbridge, Conn. This construction is accomplished by utilizing a single piece of sheet metal being taken by hand from one discrete bending or die station at a time to complete the fabrication. This method does not maximize the reduction of costly labor or maximize the reliability of construction with having manual operations and the human element substantially involved.

Other fabrication or production methods have been used in the past to form seamless manholes for steam boilers as in U.S. Pat. No. 316,312 to J. Tordoff; seamless blocking saddles for steam boilers in U.S. Pat. No. 1,413,492 to Rees; and in the formation of flanges onto tank domes in U.S. Pat. No. 1,493,224 to A. Alston Jr. all of which utilize heat applied to the metal to be worked and none of which uses a series of multiple sequential dies spaced to position a leading segment of a metal strip over the first die of the sequential dies to impart forces upon the leading segment of the strip and then subsequently moving the leading segment of the metal strip to the next die position to impart another force to the leading segment while at the same time a connected trailing segment of the strip is positioned over the first die for experiencing the force imparted by the first die. Consequently, the leading segment of the strip progresses over a sequence of dies changing its shape until the final die imparts the final shape while at the same time the trailing connected segment experiences the forces of the die the leading segment of the strip had just previously experienced. The trailing segment strip progresses through the sequence of dies changing shapes until the final die imparts the final desired shape. Thus, none of these references teach any such progressive die process to be used to form their respective shapes. Moreover, while progressive dies have been utilized in industry, none have appeared to be used in the fabrication of adaptors for trunk lines.

SUMMARY OF THE INVENTION

An object of the present invention is to provide a method for fabricating a seamless adaptor for connecting a trunk line heating, ventilation and/or air conditioning duct member to a branch conduit member, comprising steps in which one of the steps includes positioning a first segment of a strip of sheet metal at a first die assembly and exerting a force onto the first segment with the first die assembly forming an elliptical shaped segment out of said first segment, punching a hole into a central portion of the elliptical shaped segment and providing a connector strip from the sheet metal positioned between and connecting together the first segment and a trailing segment of the metal strip. Another step includes positioning the elliptical shaped segment of the first segment at a second die assembly and at the same time positioning the trailing segment at the first die assembly and exerting a force onto the first and trailing segments with the first and second die assemblies respectively, drawing the elliptical shaped segment at the second die assembly into a form having a generally cylindrical shape projecting transverse to a surface of the elliptical shaped segment and positioning the hole to be generally centered within an end of the generally cylindrical shape and forming an annular rim surrounding the hole and bending a portion of the elliptical shaped segment surrounding another end of the generally cylindrical shape forming a flange having a camber. A further step includes positioning the form at a third die assembly and at the same time positioning the trailing segment at the second die assembly and exerting a force onto the first and trailing segments with the third and second die assemblies respectively, increasing a diameter of the hole in the form of said first segment at said third die assembly and leaving a portion of the annular rim surrounding the hole positioned at the end and inside of the generally cylindrical shape. Another step includes positioning the first segment at a fourth die assembly and at the same time positioning the trailing segment at the third die assembly and exerting a force onto the first and trailing segments with the fourth and third die assemblies respectively, pushing the portion of the annular rim outwardly from the inside of the generally cylindrical shape to further increase the diameter of the hole positioned at the end of the generally cylindrical shape.

Another object of the present invention to provide a cost saving and reliable method to fabricate a number of seamless adaptors for connecting a trunk line heating, ventilation and/or air conditioning duct member to a branch conduit member.

BRIEF DESCRIPTION OF THE DRAWINGS

The foregoing objects and advantageous features of the invention will be explained in greater detail and others will be made apparent from the detailed description of the preferred embodiments of the present invention which is given with reference to the several figures of the drawing, in which.

DESCRIPTION OF THE PREFERRED EMBODIMENTS

Figures 1A, 1B, 1C, 1D, 1E:
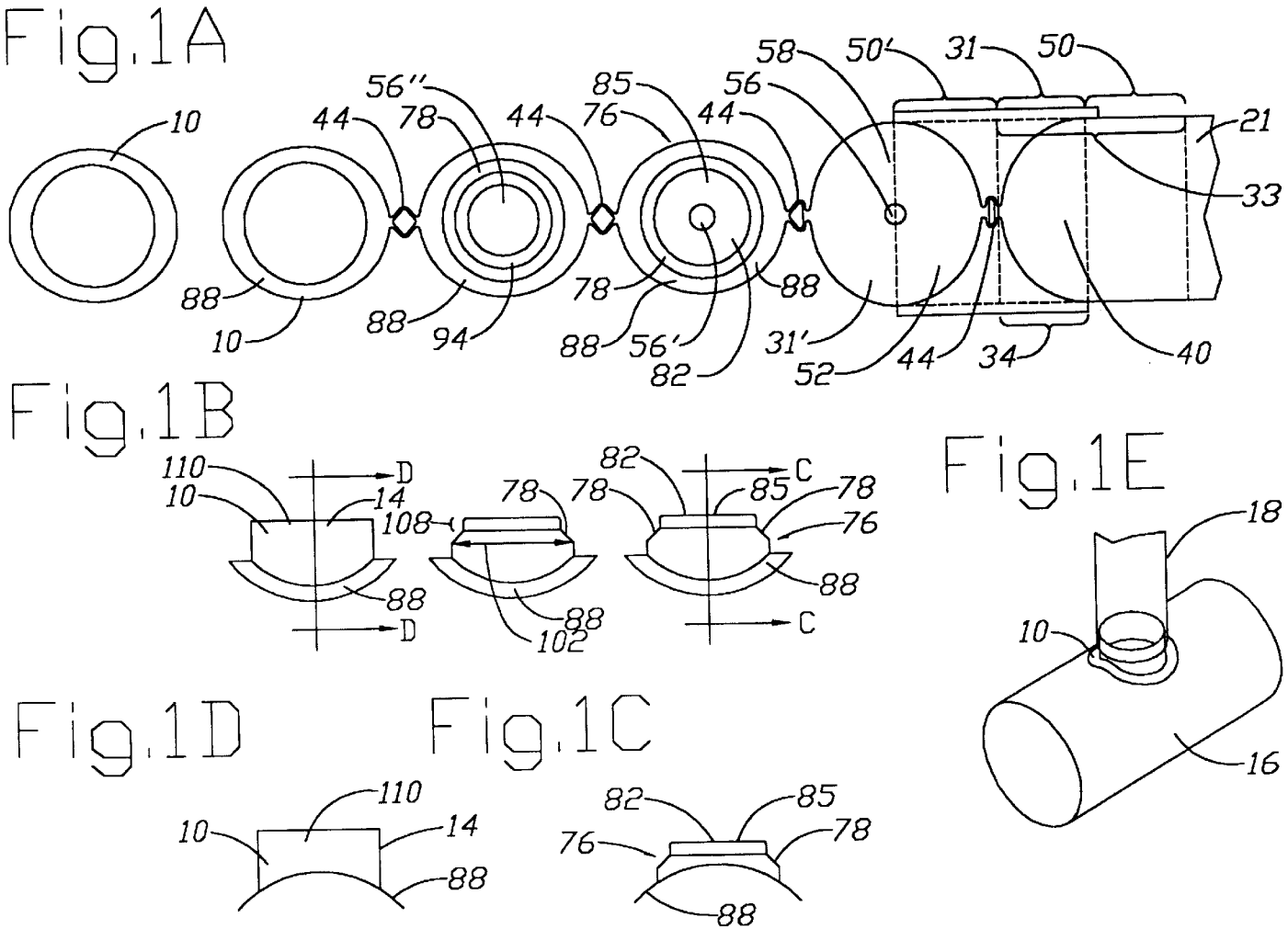
FIG. 1A is a plan view of the first embodiment of the production process for the adaptor.
FIG. 1B are corresponding side elevational views of the adaptor as it progresses through the production process of FIG. 1A.
FIG. 1C is a cross section view of the adaptor along line C—C in FIG. 1B.
FIG. 1D is a cross section view of the adaptor along line D—D in FIG. 1B.
FIG. 1E is a perspective view of the adaptor formed in FIG. 1A mounted to an HVAC trunk line.
Figures 2A, 2B, 2C, 2D, 2E:
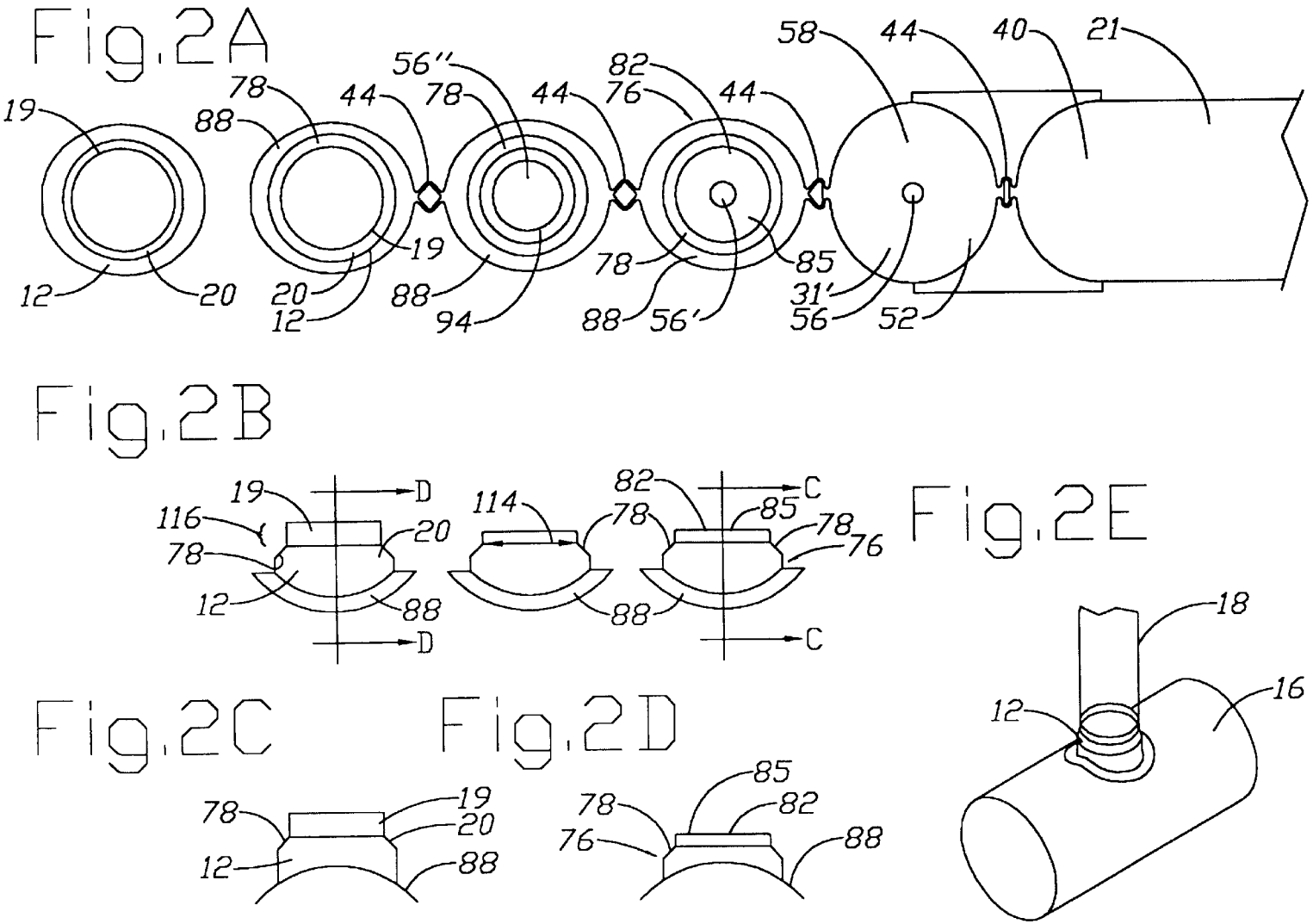
FIG. 2A is a plan view of another embodiment of the production process for the adaptor.
FIG. 2B are corresponding side elevational views of the adaptor as it progresses through the production process of FIG. 2A.
FIG. 2C is a cross section view of the adaptor along line C—C in FIG. 2B.
FIG. 2D is a cross section view of the adaptor along line D—D in FIG. 2B.
FIG. 2E is a perspective view of the adaptor formed in FIG. 2A mounted to an HVAC trunk line.

The present method is for fabricating seamless adaptors 10 and 12, as seen in FIGS. 1A–1D and 2A–2D, for connecting a trunk or main line 16 heating, ventilation and/or air conditioning duct to a branch conduit member 18, as seen in FIGS. 1E and 2E. The primary distinction between the embodiment found in 1A and the other embodiment found in 2A is that the embodiment found in 1A has its cylindrical portion 14, as seen in FIGS. 1B and 1C, substantially straight on its sides, without any shoulder disposed around cylindrical portion 14. The diameter for purposes of this embodiment would be approximately six inches. On the other hand, the embodiment found in FIGS. 2B and 2C, has cylindrical portion 19 having a reduced diameter in which shoulder 20 is disposed around cylinder portion 19. The diameter for purposes of this embodiment would be approximately five inches at cylindrical portion 19.

Figure 4A:
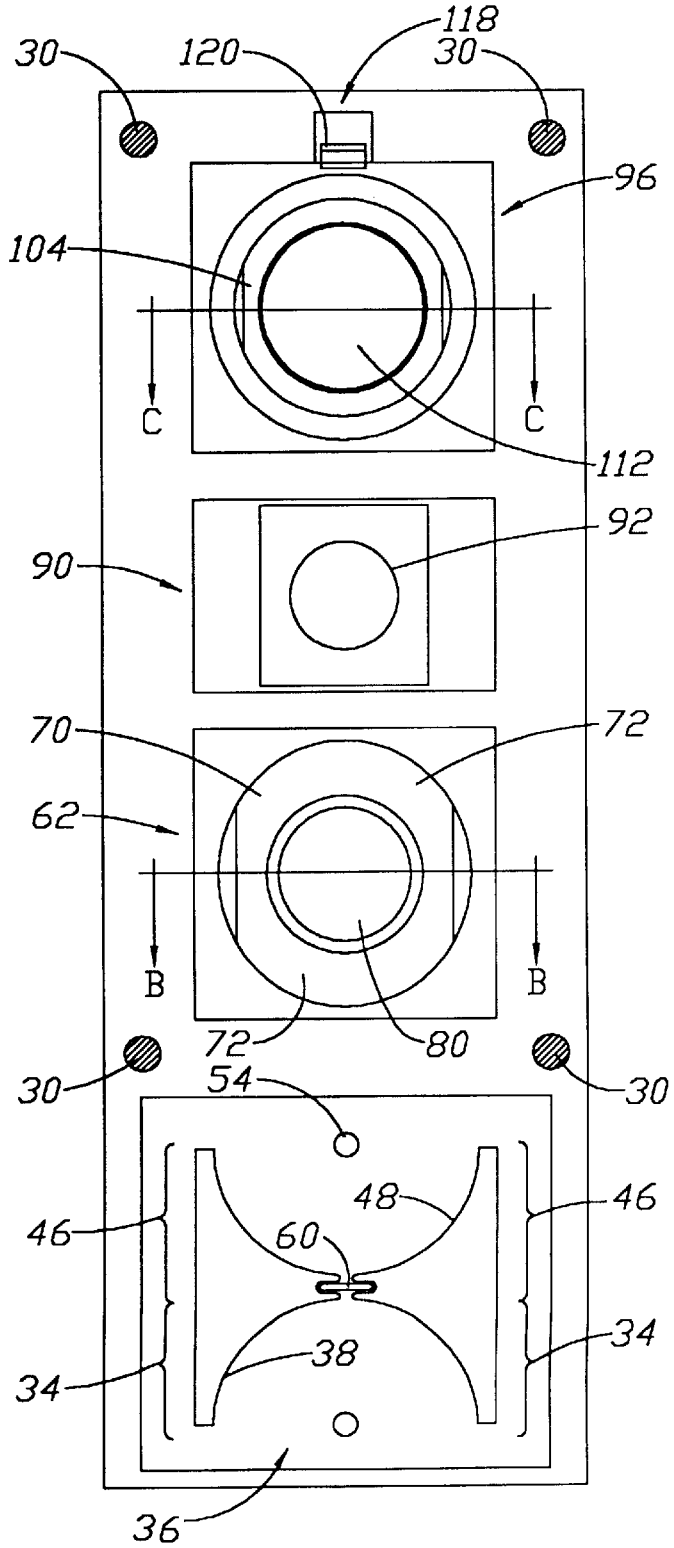
FIG. 4A is a plan view of the top portion of the punch and die assembly used to carry out the production process.
Figure 5:
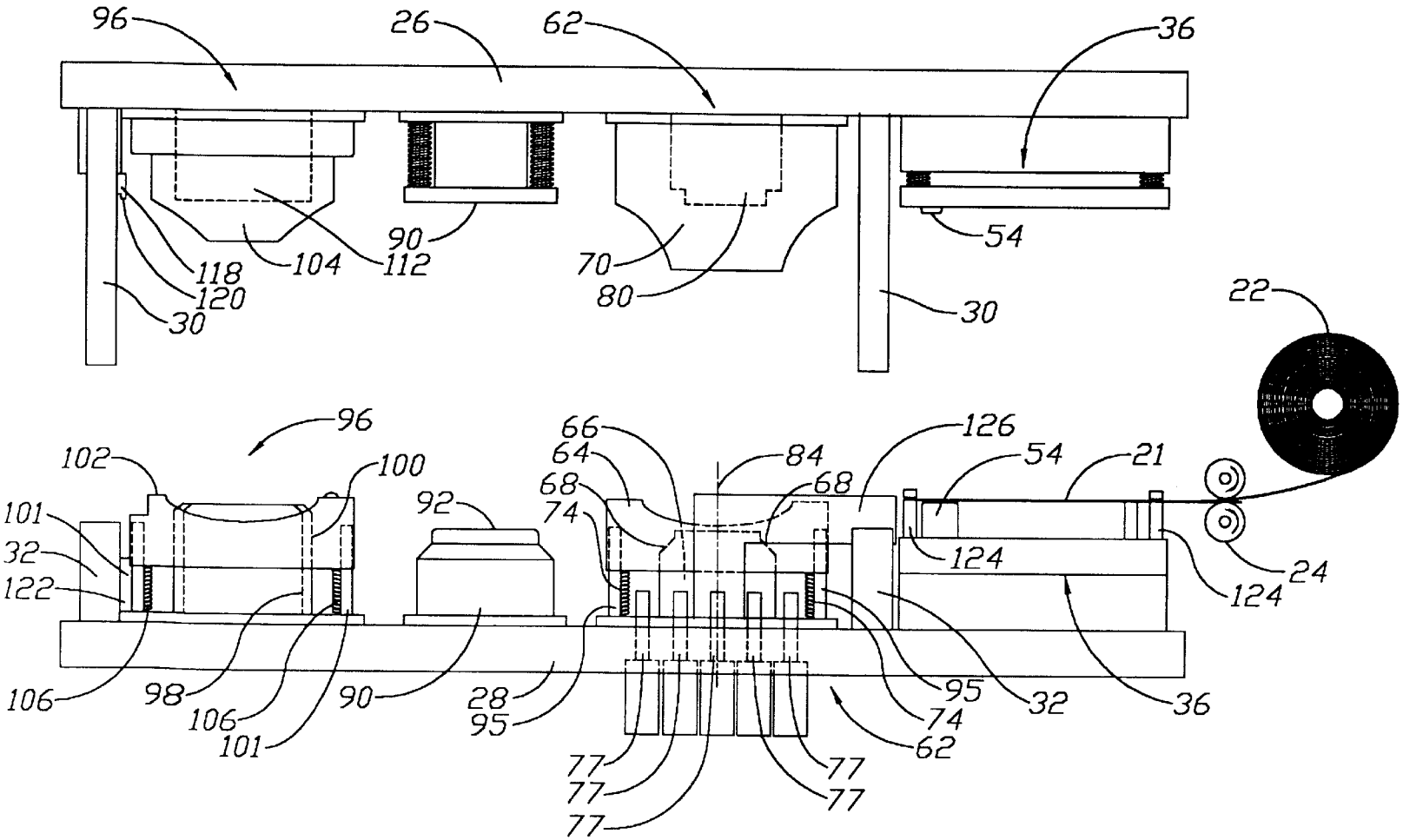
FIG. 5 is an exploded side elevation view of the top and bottom portion of the punch and die assembly of FIGS. 3A and 4A in alignment with one another with a schematic representation of a coil of steel and feeder.

The method includes using a coil 22, as seen in FIG. 5, typically made of 25 gauge galvanized cold rolled steel and approximately 12¼ inches in width. Various gauges and sizes of rolled steel are contemplated to accommodate the desired adaptor needed. Coil 22 is unrolled as the process progresses with the utilization of feeder 24 which conventionally pulls off, for the present embodiment, approximately a foot of sheet metal 21 every time the method of fabrication needs to advance a portion of metal strip 21 to the next die assembly along the row of consecutive die assemblies seen in FIGS. 3A, 4A and 5.

The fabrication method utilizes a set of die assemblies positioned substantially in a row as seen in FIGS. 3A–5. Each of these die assemblies changes the shape of metal strip 21 from its previous shape imparted to metal strip 21 from the die assembly it had just come from. Thus, a transformation of shape of metal strip 21 occurs as metal strip 21 is dispensed from coil 22 and advances metal strip 21 through consecutively aligned dies. The change in shape of metal strip 21 by each die assembly is seen in process diagrams in FIGS. 1A and 2A.

Figure 3A:
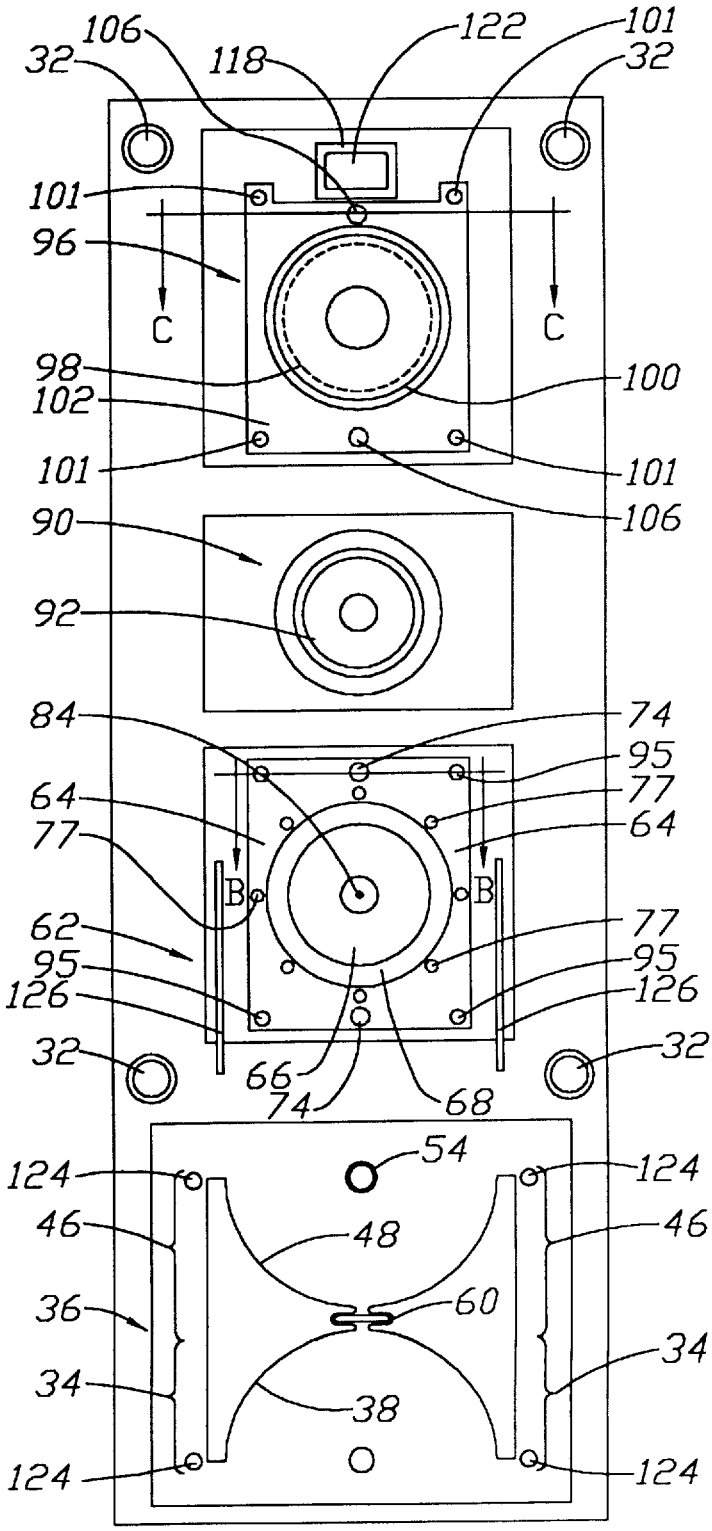
FIG. 3A is a plan view of the bottom portion of the punch and die assembly used to carry out the production process.

These die assemblies as seen in FIG. 5 are positioned with a top portion 26 of each die assembly positioned directly over a corresponding bottom portion 28 of each die assembly. During a typical process the top and bottom portions 26,28 are moved together and are maintained in registration with one another with posts 30 engaging sleeves 32 as seen in FIGS. 3A, 4A and 5. Approximately 30 tons of force is exerted with these dies onto metal strip 21 to cut, draw and extrude metal strip 21 and thereby transform the shape of metal strip 21 to take on the shapes correspondingly portrayed from right to left in FIGS. 1A–1D and 2A–2D as metal strip 21 is moved right to left through die assemblies shown in FIGS. 3A–5 with first die assembly 36 being the first die. Adaptors 10 and 12 are finally formed and cut from metal strip 21. This process will be discussed in more detail below.

The fabrication method of the adaptor has leading portion 31 of first segment 33 of sheet metal strip 21, as represented with phantom lines, as seen in FIG. 1A, being fed into a first portion 34 of first die assembly 36, as seen in FIGS. 3A and 4A. First portion 34 has cutting die 38 in the shape of half of an ellipse and with first die assembly 36 exerting a force onto leading portion 31 of first segment 33, the force cuts a first half of an elliptical shaped segment 40 with trailing portion 50 (seen in phantom) of first segment 33 not yet positioned in first die assembly 36, as seen in FIGS. 1A and 2A.

Leading portion 31' of first segment 33, now a half of an ellipse, a seen in FIG. 1A, is advanced beyond second portion 46 of first die assembly 36, as seen in FIGS. 3A and 4A. Second portion 46 of first die assembly 36 has another cutting die 48 which with exerting force through first die assembly 36 onto trailing portion 50' of first segment 33, now positioned at cutting die 48, remaining half of elliptical shaped segment 52 is formed, as seen in FIG. 1A.

Punching die 54 is circular and is also positioned in second portion 46 of first die assembly 32. Punching die 54 is positioned such that with the exertion of force with first die assembly 36, punching die 54 cuts hole 56 into a central portion of elliptical shaped segment 58.

Further cutting die 60, as seen in FIGS. 3A, and 4A, is also provided, for this embodiment, in second portion 46 of first die assembly 36 such that with a force exerted onto trailing portion 50' of first segment 33 through further cutting die 60, as seen in FIGS. 3A and 4A, connector strip 44 is formed, as seen in FIGS. 1A and 2A. Connector strip 44 now becomes that which connects first segment 33 to a trailing segment of sheet metal strip 21.

Connector strip 44 can be seen in FIGS. 1A and 2A separating, connecting and facilitating spacing the shapes formed in sheet metal strip 21 as it progresses through the series of die assemblies.

In this embodiment, elliptical shaped segment 58 is, in this embodiment, nine and one half inches by ten and three quarters inches (9½"×10¾") and hole 54 is approximately one inch (1") in diameter when leaving first die assembly 36. Thus, sheet metal strip 21 is advanced moving first segment 33 or now elliptical shaped segment 58 from first die assembly 36 to second die assembly 62, at the same time, because connector strip 44 connects elliptical shaped segment to trailing segment, now seen as first segment 33, in FIGS. 1A and 2A, trailing segment is positioned at first die assembly 36. The trailing segment progresses through first die assembly 36 the same as described for first segment 33 of sheet metal strip 21 above.

Figure 3B:
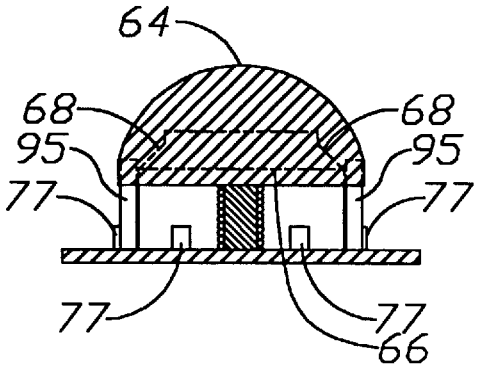
FIG. 3B is a cross section view of the second die assembly along line B—B in FIG. 3A.
Figure 3C:
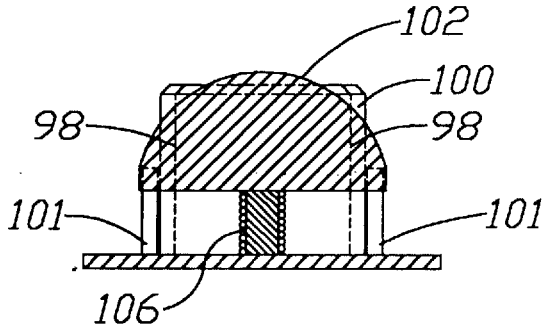
FIG. 3C is a cross section view of the fourth die assembly along line C—C in FIG. 3A.
Figure 4B:
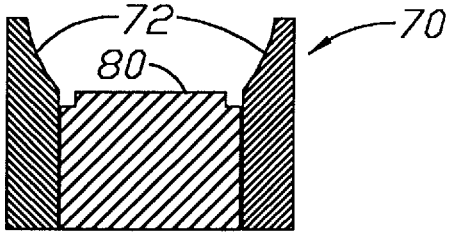
FIG. 4B is a cross section view of the second die assembly along line B—B in FIG. 4A.

In this embodiment, the trailing segment is experiencing the force exerted with second portion 46 of first die assembly 36 at the same time first segment 33 or elliptical shaped segment 58 experiences force exerted with second die assembly 62. Second die assembly 62, as seen in FIGS. 3A, 3B, 3C and 5, provides first generally cylindrical shape die member 66 positioned transverse to second partially cylindrical shape die member 64 in which second cylindrical die member 64 is positioned transverse to longitudinal axis 84, as seen in FIGS. 3A and 5, of first generally cylindrical die member 66. First generally cylindrical shape die member 66 has die shoulder 68 formed about a circumference. Compatible die member 70, as seen in FIGS. 4A, 4B and 5, is structured to have a recessed partially cylindrical shape 72, as seen in FIG. 4B, at the top portion 26 of die assembly to receive second partially cylindrical shape die member 64 when top and bottom portions 26,28 are brought together for exerting forces onto sheet metal strip 21 and more particularly, exerting forces onto sheet metal strip 21 on portion 88 of elliptical shaped segment 58, as seen in FIGS. 1A and 2A. With the moving together of these two portions 26,28 recessed partially cylindrical shape 72 receives and exerts a force downward onto first segment 33 or portion 88 and second cylindrical die member 64. Second partially cylindrical shape die member 64 moves resiliently downward being mounted on springs 74. These compression springs 74 typically are 1¼" in diameter by 7" long blue die springs with 104 pounds per inch deflection. Springs 74 are primarily for returning second partially cylindrical die member 64 to its original position once the force between two portions 26,28 of the top and bottom die assemblies is removed.

These springs 74 in and of themselves do not provide the complete resisting force needed for the drawing process of elliptical shaped segment 58 which includes recessed partially cylindrical shape 72 pushing against second partially cylindrical die member 64 and moving downwardly and first generally cylindrical die member 66 exerting a force on elliptical shaped segment 58 drawing form or generally cylindrical shape 76. An additional force is needed to be exerted onto second partially cylindrical die member 64 to resist or oppose the force of recessed partially cylindrical shape 72 pushing onto portion 88 of elliptical shaped segment 58 positioned between second cylindrical die member 64 and recessed cylindrical shape 72. This additional force is applied with the utilization of gas pressurized pistons 77, as seen in FIGS. 3A, 3B and 5. In this embodiment eight nitrogen gas pistons are used which are hosed together using a manifold and control gauge to adjust the pressure. The ones used in this embodiment are Hyson Model TNK 400 1½" diameter and 2" stroke drawing pressure in system in around 500 psi which equates to a rate of 1600 pounds at initial and 2700 pounds at full compression. These gas pistons 77 allow the operator to have adjustability with regard to the resisting force applied under second partially cylindrical die member 64 thereby allowing first generally cylindrical die member 66 to draw, as second partially cylindrical die member 64 moves downwardly, the material evenly and without wrinkles because the operator can apply significant resisting force with gas pistons 77 for holding portion 88 in place during the drawing procedure. Compression springs are not as desirable as the adjustable gas pistons 77 because they do not provide adjustability for accommodating various materials and respective needed forces to accomplish the desired drawing of the material.

First segment 33 or elliptical shaped segment 58 is drawn over first generally cylindrical die member 66 forming a corresponding generally cylindrical form 76, generally transverse to elliptical shaped segment 58, with shoulder 78 disposed about form 76, as seen in FIGS. 1B and 1C. At the same time, the diameter of hole 56' is increased, as seen in FIG. 1A. With the downward movement of compatible cylinder member 80 disposed in compatible die member 70, as seen in FIGS. 4A and 5, annular rim or flattened top portion 82 is also formed adjacent hole 56', as seen in FIGS. 1A, 1B and 1C. This drawing process includes positioning hole 56 in alignment with a longitudinal axis 84 of generally cylindrical die member 66, as seen in FIGS. 3A and 5, as a result generally centering hole 56 within end 85 of form or generally cylindrical shape 76. When the drawing process is complete at second die assembly 62, hole 56' will generally be centered at end 85.

Finally, this drawing process at the same time also includes bending portion 88 of generally elliptical shaped segment or form 76 surrounding another end 86 of form 76 forming flange 88, as seen FIGS. 1A having a camber comparable to the surface of second partially cylinder die member 64 and generally transverse to form 76. This is accomplished with portion 88 positioned between cylindrical die member 64 and recessed cylinder shape 72 during the drawing process.

This process of fabrication includes again advancing sheet metal strip 21 and positioning form 76, or as originally referred to as first segment 33, at third die assembly 90 and at the same time positioning the trailing segment, which has now become elliptical in shape, at second die assembly 62 and exerting a force onto first and trailing segments with third and second die assemblies 90,62 respectively, increasing diameter of hole 56" with third die assembly 90 to a diameter in this embodiment of 3¾". Third die assembly 90 includes circular cutting die 92 which exerts a force onto annular rim 82 at end 85 of form 76 of first segment 33 leaving portion of annular rim 94 positioned at end 85 and inside of generally cylindrical shape or form 76.

The fabrication process includes advancing sheet metal strip 21 again and thereby positioning first segment 33 at fourth die assembly 96. At the same time, the trailing segment, which is now in the shape of form 76, is positioned at third die assembly 90. A force is exerted onto first segment 33 and the trailing segment with fourth and third die assemblies 90,96 respectively, pushing portion of said annular rim 94 outwardly from the inside of generally cylindrical shape or form 76 to further increase the diameter of hole 56" positioned at end 85 of generally cylindrical shape or form 76.

The two embodiments of fourth die assembly die 96 are shown in FIGS. 3A, 4A and 5. the basic difference between the two embodiments is that the diameter of a cylindrical die assembly in fourth die assembly 96 is larger in the first embodiment than in the second embodiment 98.

Figure 4C:
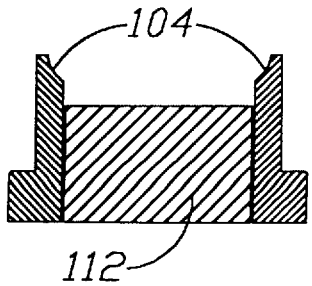
FIG. 4C is a cross section view of the fourth die assembly along line C—C in FIG. 4A.

With regard to the first embodiment, additional cylinder die member 100 which is generally cylindrical in shape and has a relatively larger diameter than second embodiment 98, is positioned at fourth die assembly 96 and has a diameter which is approximately the inner diameter of form 76 at its greatest diameter 102 at shoulder 78, as seen in FIG. 1B. As top and bottom portions 26,28 of the die assemblies are brought together, fourth die assembly 96 operates similarly to second die assembly 62. Flange 88 of form 76 rests upon generally horizontal partial cylinder die member 102, as seen in FIGS. 3A, 3C and 5. Generally horizontal partial cylinder die member 102 moves downwardly as force is exerted on it from generally horizontal partial cylinder recess die member 104, as seen in FIGS. 4A, 4C and 5. Recess die member 104 is complimentary in shape to the surface of horizontal cylinder die member 102 and secures flange 88 between die members 102,104. Die member 102 is mounted with spring supports 106 and allows die member 102 to move downwardly under the force exerted from die member 104 allowing additional cylinder die member 100 to exert force on generally cylindrical shape or form 76 at shoulder 78 pushing and bending remainder 108 of generally cylindrical shape or form 76 having a smaller diameter, as well as, portion of annular rim 94 outwardly at end 85. As a result, remainder 108 portion of form 76 and portion of annular rim 94 take on cylindrical shape 110 having the diameter of additional cylinder die member 100, as seen in FIGS. 1B and 1D. Corresponding top cylinder die 112, as seen in FIG. 4C is positioned to allow cylindrical shape 110 to reach its fullest extension.

The second embodiment 98 operates the same as the first embodiment described immediately above for fourth die assembly 96, except the results are different. The use of second embodiment 98 with a smaller diameter for additional cylinder die member, in which the diameter of die member 98 is approximately diameter 114, as seen in FIG. 2B, which is the smallest diameter of shoulder 78. Thus, exerting a force generally cylindrical shape or form 76 at shoulder 78, additional cylinder die 98 passes by shoulder 78 leaving it disposed in form 76 and engages portion of annular rim 94 pushing it outwardly at end 85. As a result, portion of said annular rim 94 generally conforms to form extension 116 of generally cylindrical shape 76 having a diameter of additional cylinder die member 98. Likewise, top cylinder 112 as seen in FIG. 4C is positioned to allow generally cylinder shape 76 to extend at 116.

It should be noted that it is recommended that guide posts 95 be used in conjunction with second die assembly 62 and particularly cylindrical die member 64 which rides downwardly on springs 74. Guide posts 95 are positioned inside openings in second partially cylindrical die member 64 and keep die member 64 aligned with compatible die member 70 with die member 64 moving down and then up on each drawing effort by second die assembly 62. Likewise, this is the case with guide posts 101, as seen in FIG. 5, which keep generally horizontal cylinder die member 102 in alignment with generally horizontal cylinder recess die 104 as generally horizontal cylinder die member 102 moves downwardly and upwardly on spring supports 106.

The fabricating process includes the step of positioning first segment 33 at fifth die 118 assembly and at the same time positioning trailing segment at the fourth die assembly 96. With the exerting of a force with fourth and fifth die assemblies 96,118 respectively and exerting a force onto first segment 33 and trailing segment, connector strip 44 is cut off with cutting surface 120, as seen in FIGS. 4A and 5, with connector strip 44 falling into collector bin 122. Upon connector strip 44 being cut off, adaptors 10 and 12 are completed.

This method includes providing means for maintaining alignment of said first 33, trailing, third and fourth segments of sheet metal 21 in alignment with said fourth, third, second and first die assemblies 96, 90, 62 and 36 respectively. This means for maintaining alignment can be seen in FIGS. 3A and 5. Guide posts 124 are positioned on either side of sheet metal strip 21 as sheet metal strip is advanced through first die assembly 36. As sheet metal strip 21 is advanced to second die assembly 62 guide rails 126 maintain alignment of sheet metal strip 21.

As can be appreciated by the above, this method was described with the utilization of a first segment 33 and a trailing segment behind it all coming from coil 22, however, in full production of the process a third segment of sheet metal strip 21 is connected to trailing segment with connector strip 44 and likewise a fourth segment is connected to the third strip with a connector strip 44 and so on. Thus, with first segment 33, for example, positioned at third die assembly 90, trailing segment is positioned at second die assembly 62 and third segment is positioned at first die assembly 36 and a force is exerted on each one of these segments with the respective die at the same time. Thereafter, sheet metal strip 21 advances again and the method has portions or segments of sheet metal strip 21 including first 33, trailing, third and fourth segments being positioned in registration with fourth, third, second and first die assemblies 96,90,62,36, respectively. Likewise force is exerted onto each of the four segments at the same time by these respective dies. This process is continuous and as soon as one segment is cut from strip 21 another enters first die assembly.

While a detailed description of the preferred embodiments of the invention has been given, it should be appreciated that many variations can be made thereto without departing from the scope of the invention as set forth in the appended claims.

What is claimed is:

1. A method for fabricating a seamless adaptor for connecting a trunk line heating, ventilation and/or air conditioning duct member to a branch conduit member, comprising the steps of:

positioning a first segment of a strip of sheet metal at a first die assembly and exerting a force onto the first segment with said first die assembly forming an elliptical shaped segment out of said first segment; and positioning said elliptical shaped segment of said first segment at a second die assembly drawing said elliptical shaped segment at said second die assembly into a form having a generally cylindrical shape projecting transverse to a surface of the elliptical shaped segment.

2. The method of claim 1 including the step of forming a connection between the first segment and a trailing segment of the metal strip at the first die assembly.

3. The method of claim 2 including the step of positioning the trailing segment at the first die assembly and exerting a force onto the first and trailing segments with the first and second die assemblies respectively.

4. The method of claim 3 including the step of positioning said form at a third die assembly and at the same time positioning said trailing segment at said second die assembly and exerting a force onto said first and trailing segments with said third and second die assemblies respectively.

5. The method of claim 4 including the step of positioning said first segment at a fourth die assembly and at the same time positioning said trailing segment at said third die assembly and exerting a force onto the first and trailing segments with the fourth and third dies, respectively.

6. The method of claim 1 including the step of providing a connector strip positioned between and connecting together the first segment and a trailing segment of the metal strip.

7. The method of claim 1 including the step of punching a hole into a central portion of the elliptical shaped segment.

8. The method of claim 7 including the step of positioning said hole to be generally centered within an end of said generally cylindrical shape and forming an annular rim surrounding said hole.

9. The method of claim 8 including the step of bending a portion of said elliptical shaped segment surrounding another end of said generally cylindrical shape forming a flange having a camber.

10. The method of claim 9 including the step of positioning said form at a third die assembly and at the same time positioning said trailing segment at said second assembly and exerting a force onto said first and trailing segments with said third and second die assemblies respectively.

11. The method of claim 10 including the step of increasing a diameter of said hole in said form of said first segment at said third die assembly and leaving a portion of said annular rim surrounding said hole positioned at said end and inside of said generally cylindrical shape.

12. The method of claim 11 including the step of positioning said first segment at a fourth die assembly and at the same time positioning said trailing segment at said third die assembly.

13. The method of claim 12 including the step of exerting a force onto said first and trailing segments with said fourth and third die assemblies respectively.

14. The method of claim 13 including the step of pushing said portion of said annular rim outwardly at said fourth die assembly from the inside of said generally cylindrical shape to further increase the diameter of said hole positioned at said end of said generally cylindrical shape.

* * * * *